US008966864B2

(12) United States Patent
Rabec

(10) Patent No.: US 8,966,864 B2
(45) Date of Patent: Mar. 3, 2015

(54) PACKAGING INSTALLATION FOR BATCHES OF PRODUCTS

(75) Inventor: Dominique Rabec, Octeville-sur-Mer (FR)

(73) Assignee: C.E.R.M.E.X. Constructions Etudes et Recherches de Materiels pour l'Emballage d'Expedition, Corcelles-les-citeaux (FR)

( * ) Notice: Subject to any disclaimer, the term of this patent is extended or adjusted under 35 U.S.C. 154(b) by 895 days.

(21) Appl. No.: 13/186,693

(22) Filed: Jul. 20, 2011

(65) Prior Publication Data

US 2012/0023866 A1 Feb. 2, 2012

(30) Foreign Application Priority Data

Jul. 28, 2010 (FR) ..... 10 56215

(51) Int. Cl.

| | |
|---|---|
| ***B65B 11/00*** | (2006.01) |
| ***B65B 65/00*** | (2006.01) |
| ***B65B 59/00*** | (2006.01) |
| *B65B 59/04* | (2006.01) |

(52) U.S. Cl.

CPC ..... *B65B 65/003* (2013.01); *B65B 59/005* (2013.01); *B65B 59/04* (2013.01)

USPC ..... 53/210; 198/586; 198/861.1; 198/809

(58) Field of Classification Search

CPC ..... B65B 11/06; B65B 59/04; B65B 59/00; B65B 59/005; B65B 21/06; B65B 2207/08; B65B 2207/14; B65B 2207/16; B65B 2207/30

USPC ..... 53/201, 203, 218, 465, 210, 233; 198/586, 809, 861.1, 418, 836.3

See application file for complete search history.

(56) References Cited

U.S. PATENT DOCUMENTS

| | | | | |
|---|---|---|---|---|
| 2,632,557 | A * | 3/1953 | Lindberg | 198/861.1 |
| 3,243,033 | A * | 3/1966 | Merchant et al. | 198/577 |
| 3,729,083 | A * | 4/1973 | Wollenhaupt et al. | 198/345.3 |
| 3,739,904 | A | 6/1973 | Windstrup | |
| 4,194,633 | A * | 3/1980 | Paterson et al. | 209/152 |

(Continued)

FOREIGN PATENT DOCUMENTS

| | | |
|---|---|---|
| DE | 20 2005 018076 U1 | 3/2007 |
| WO | 03/078282 A1 | 9/2003 |

OTHER PUBLICATIONS

French Preliminary Search Report for FR 1056215, dated Mar. 17, 2011.

*Primary Examiner* — Thanh Troung
*Assistant Examiner* — Dianne Mitchell
(74) *Attorney, Agent, or Firm* — Sughrue Mion, PLLC

(57) ABSTRACT

The installation includes an infeed conveyor (7) and an outfeed conveyor (8) with a module (5) for forming a wrapping of the tray, a cleated belt conveyor (11) constituted by two continuous belts (11*a*, 11*b*) which are retractable so as to allow the installation of a substitute conveying system (13) which is capable of forming a continuous slider bed between the infeed conveyor (7) and the outfeed conveyor (8). Accordingly, a versatile installation is provided that is capable of carrying out wrapping operations with blanks of the tray or wrap-around type and transporting batches of products, the products being, for example, placed on supporting cardboard sheets so as to convey them to the packing machine to receive a plastic film and then into the heat-shrink tunnel to complete the wrapping.

9 Claims, 4 Drawing Sheets

(56) References Cited

U.S. PATENT DOCUMENTS

| | | | | | |
|---|---|---|---|---|---|
| 4,643,299 | A * | 2/1987 | Calundan | 198/812 |
| 4,709,531 | A * | 12/1987 | Denda | 53/415 |
| 4,925,009 | A * | 5/1990 | Hill | 198/583 |
| 4,955,464 | A * | 9/1990 | Burger et al. | 198/463.3 |
| 5,421,446 | A * | 6/1995 | Koch et al. | 198/369.7 |
| 5,427,228 | A * | 6/1995 | Delsanto | 198/586 |
| 5,813,518 | A | 9/1998 | Kirker | |
| 5,823,316 | A * | 10/1998 | Shaw et al. | 198/341.04 |
| 6,012,568 | A * | 1/2000 | Kane | 198/817 |
| 6,128,888 | A * | 10/2000 | Gambetti | 53/465 |
| 6,409,011 | B1 * | 6/2002 | Ferguson | 198/861.3 |
| 6,427,831 | B1 * | 8/2002 | Norton | 198/841 |
| 6,484,475 | B1 * | 11/2002 | Neagle et al. | 53/167 |
| 6,588,173 | B1 * | 7/2003 | Moore et al. | 53/48.4 |
| 6,607,066 | B1 * | 8/2003 | Andersen et al. | 198/370.04 |
| 6,688,458 | B2 * | 2/2004 | Prentice et al. | 198/502.2 |
| 7,316,308 | B2 | 1/2008 | Ullrich et al. | |
| 7,328,554 | B1 * | 2/2008 | Cerf | 53/465 |
| 7,650,729 | B2 * | 1/2010 | Whittlesey | 53/138.2 |
| 7,909,159 | B1 * | 3/2011 | Zats et al. | 198/586 |
| 7,918,332 | B2 * | 4/2011 | Vaughn et al. | 198/801 |
| 8,356,456 | B2 * | 1/2013 | Floding et al. | 53/218 |
| 8,684,171 | B1 * | 4/2014 | Bouldin et al. | 198/860.2 |
| 2004/0083689 | A1 * | 5/2004 | Floding et al. | 53/465 |
| 2004/0083690 | A1 * | 5/2004 | Gambetti | 53/498 |
| 2005/0072123 | A1 * | 4/2005 | Gambetti | 53/465 |
| 2007/0114265 | A1 | 5/2007 | Ullrich et al. | |
| 2008/0060909 | A1 * | 3/2008 | DeVries | 198/300 |
| 2009/0294246 | A1 * | 12/2009 | Pogue | 198/313 |
| 2010/0170201 | A1 * | 7/2010 | Aquarius | 53/443 |
| 2012/0324833 | A1 * | 12/2012 | Koch et al. | 53/452 |
| 2013/0277175 | A1 * | 10/2013 | Campbell et al. | 198/586 |

* cited by examiner

PACKAGING INSTALLATION FOR BATCHES OF PRODUCTS

The present invention relates to packaging installations for batches of products, in particular under plastic film.

These packaging installations are currently capable of processing batches of products having various formats; however, this development in formats has given rise to other perspectives such as changes with respect to the preparation and pre-packaging processes for these batches of products before they are covered with plastic film, in particular.

In these packaging installations, the wrapping stations and/or modules which are situated upstream of the final phase of applying the plastic film are very often defined by one specific mode of operation; at these stations and/or modules, the pre-packaging and/or wrapping operations of batches of products of a particular type are carried out, such as for example, a wrapping formed from a cardboard blank of the tray or wrap-around type, said wrapping then passing into the packing machine to be wrapped in a plastic film before passing through the tunnel for the heat-shrinking of said plastic film.

The preparation module for this type of wrapping comprises a cleated belt conveyor to support the blanks, said cleats forming a sort of reference and making it possible to carry out a precise folding operation of the blank.

This preparation module for wrap-around or tray type wrapping also generally comprises a complementary apparatus which, in the final phase of the process of forming the wrapping, carries out the folding and forming of the blank. This apparatus is situated above the level of the downstream portion of the cleated belt conveyor and projects substantially over the outfeed conveyor which extends the wrapping preparation module in a downstream direction.

This wrapping preparation module therefore exhibits characteristics which define the installation as a single packaging mode.

On the other hand, downstream of this preparation module, the packing machine and the tunnel for heat-shrinking the plastic film are machines which can accept all sorts of batches of products: batches of products already packaged in a wrapping of the tray or wrap-around type or simply batches of products which are grouped together, or not, on a single sheet of cardboard; it is the heat-shrinkable plastic film which will secure and/or form the final wrapping. These end-of-line packing or tunnel machines can also be idle and serve simply as transit conveyors.

The current packaging installations do not therefore allow these end-of-line machines constituted by the packing machine and the heat-shrink tunnel to be used for anything other than their initial purpose; they do not provide any versatility.

The present invention proposes a packaging installation for products which, appropriately, has a certain versatility as regards the modes of preparation and pre-packaging of the products, i.e. an installation which can accommodate several modes of packaging of the batches of products and all sorts of types of batches of products.

The present invention proposes an improvement to this type of packaging installation which gives it the ability to perform the wrapping operations of the tray or wrap-around type and, also, simply to carry out the transportation of the products or batches of products, i.e. passing these naked products or batches of products into the installation, before, optionally, placing them under plastic film and passing them through the heat-shrink tunnel in order to complete the wrapping.

The installation according to the invention therefore becomes very versatile in use and can accommodate the processing of large or small runs of batches of products with wrappings of all types, adapted to the batches in question; it can also simply provide the transport of the products or group of products, as required, when the packing machine and the heat-shrink tunnel are not operational, for example.

The packaging installation for batches of products according to the invention comprises, distributed on a single common frame:

an infeed conveyor on which the products are arranged in batches, originating from a grouping station, an outfeed conveyor which removes the products in the form of batches to a packing machine and, between the two, a module for forming a wrapping of the tray or wrap-around type, comprising on the one hand a cleated belt conveyor constituted by two continuous belts forming a slider bed which extends between said infeed conveyor and said outfeed conveyor, said continuous belts being adjustable transversally in order to alter the width of said slider bed, and, on the other hand, an apparatus for folding and forming the wrapping, arranged above the end portion of said slider bed formed by said cleated conveyor belt, said installation comprising means for retracting said continuous belts and means allowing the substitution of said continuous belts by a conveying system capable of allowing a simple passage of said naked batches of products between said infeed conveyor and said outfeed conveyor, said substitute conveying system being interposed between said continuous belts in order to form a continuous slider bed between said infeed and outfeed conveyors.

According to a preferred provision of the invention, the installation comprises a conveying system which is constituted by several endless transfer conveyor belts: at least one upstream transfer conveyor belt and at least one downstream transfer conveyor belt, said transfer conveyor belts capable of being placed in abutment with each other and respectively with the infeed conveyor and the outfeed conveyor, said upstream and downstream transfer conveyor belts filling the gap between said infeed and outfeed conveyors after retraction of the cleated belt conveyor and, in particular, after separation of the continuous belts of said cleated belt conveyor of the forming module for wrappings of the tray or wrap type.

According to another provision of the invention, the substitute conveying system is constituted by two transfer conveyor belts which are mobile with respect to each other in the longitudinal direction of movement of the batches of products and in a vertical direction, said belts being mobile with respect to each other between an idle position in which they are superposed and an active position in which they abut in the same plane in order to form the portion of slider bed which extends between the infeed conveyor and the outfeed conveyor, substituting for the continuous belts of the cleated belt conveyor.

Still according to the invention, the substitute conveying system is vertically mobile, borne by a support which is integral with the common frame of the installation and/or the forming module and which extends above the slider bed for the transportation of batches of products, opposite the upstream portion of the cleated belt conveyor and upstream of the apparatus which carries out the folding and the final forming of the blank of the tray or wrap type.

According to another provision of the invention, the support of the substitute conveying system is constituted, on each side, by a pantograph which extends between the frame of the installation and/or of the module for forming the wrapping and a structure which bears the upstream transfer conveyor belt, said structure serving at the same time as a guide for the frame of the downstream transfer conveyor belt.

Still according to the invention, the pantograph comprises scissor arms arranged laterally, said arms being sufficiently spaced apart in a transversal direction so as to leave a maximum amount of free space and allow the passage of naked batches of products and, in particular, the passage of batches which do not require a particular wrapping operation with a blank of the tray or wrap-around type, said arms being operated by appropriate means of the screw-nut type in order to change the conveying system from its idle position to its active position and vice-versa, according to requirements.

According to another provision of the invention, the downstream transfer conveyor belt is arranged on a supporting member which is borne by the structure of the upstream transfer conveyor belt by means of a system of guide rails, said system of guide rails making it possible, under the effect of appropriate operating means, to retract said downstream transfer conveyor belt under said upstream transfer conveyor belt in order to give the entire substitute conveying system a footprint compatible with the space which is available upstream of the wrapping assembly apparatus and within the footprint of the forming module.

Still according to the invention, the downstream transfer conveyor belt is mounted vertically mobile with respect to its frame between an active substitution position in which it is situated at the level of the outfeed conveyor and an idle position in which it is situated below the level of the upstream transfer conveyor belt, said downstream transfer conveyor belt comprising legs and being mounted mobile with respect to said frame by means of its legs which slide vertically in said frame, said active substitution position being obtained using supports arranged on the common frame and on which said legs rest.

In order to be capable of application, the invention is disclosed in a clear and complete fashion in the description hereinafter, with reference to the following drawings in which.

Figure 2:
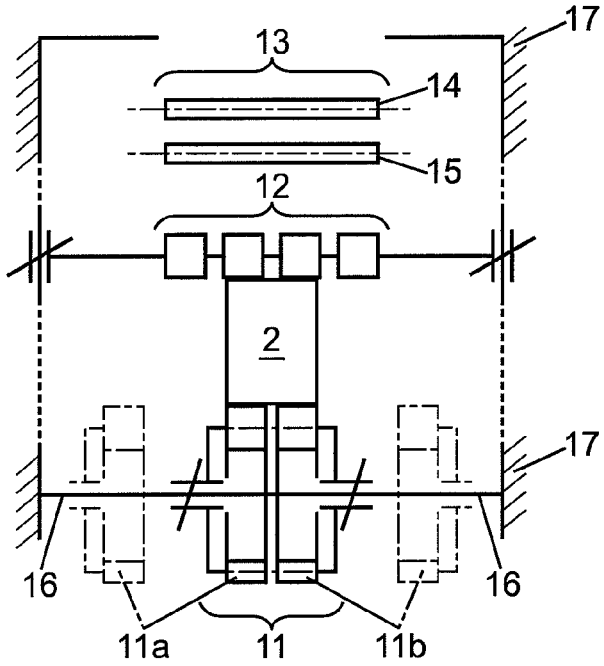
FIG. 2 is a diagrammatic elevation in cross-section along II-II of FIG. 1, showing the cleated belt conveyor in the active position whilst the substitute transfer conveyor belt is in the idle position above the level of the wrapping assembly apparatus.
Figure 3:
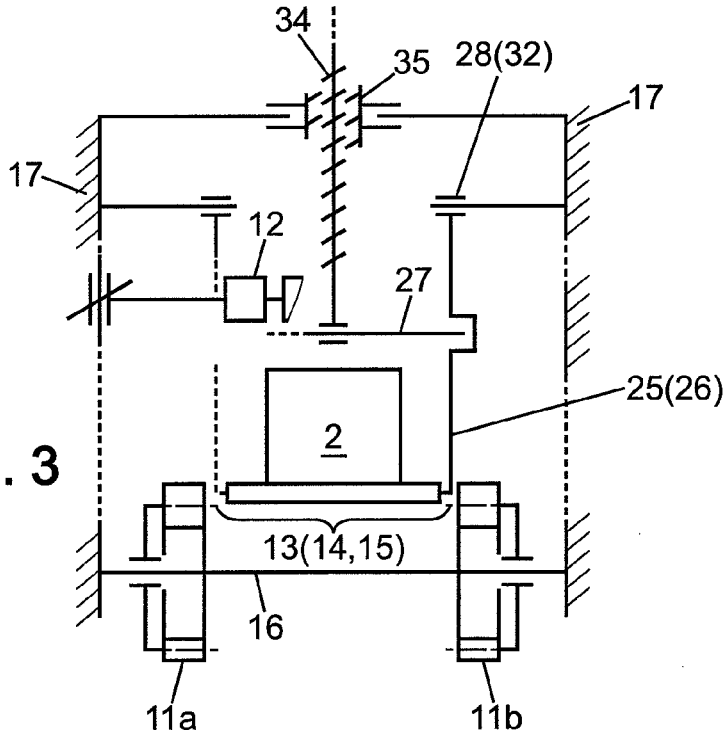
Figure 4:
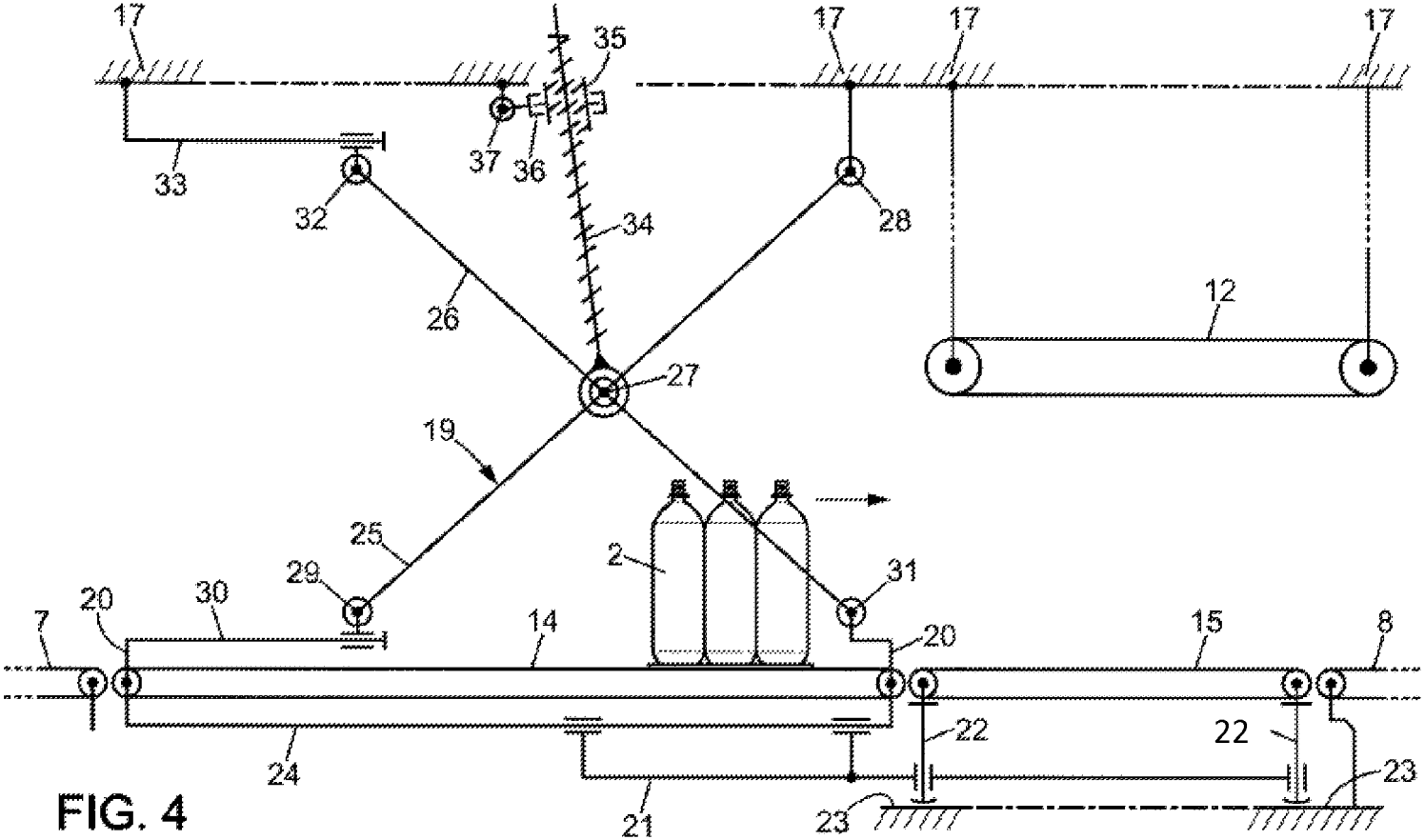
Figure 5:
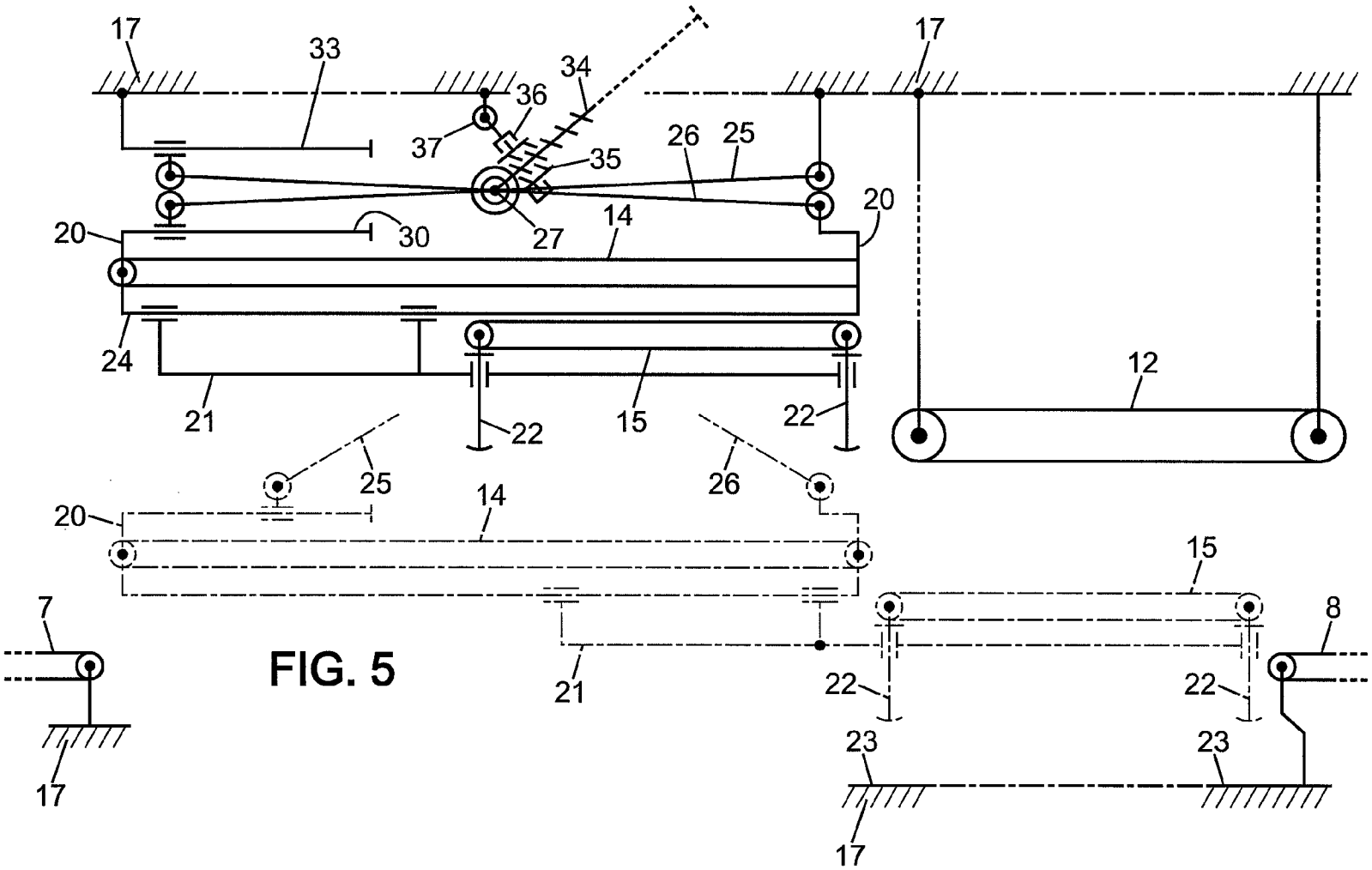

FIG. 3 corresponds to FIG. 2 in the case of the passage of naked batches of products;

FIG. 4 is a diagrammatic elevation of the installation showing the substitute transfer conveyor belt in the active position between the infeed and the outfeed conveyor;

FIG. 5 shows the substitute transfer conveyor belt in the idle position and, represented in light dot-and-dash lines, this same substitute transfer conveyor belt in an intermediate position between its active position and its idle position.

Figure 1:
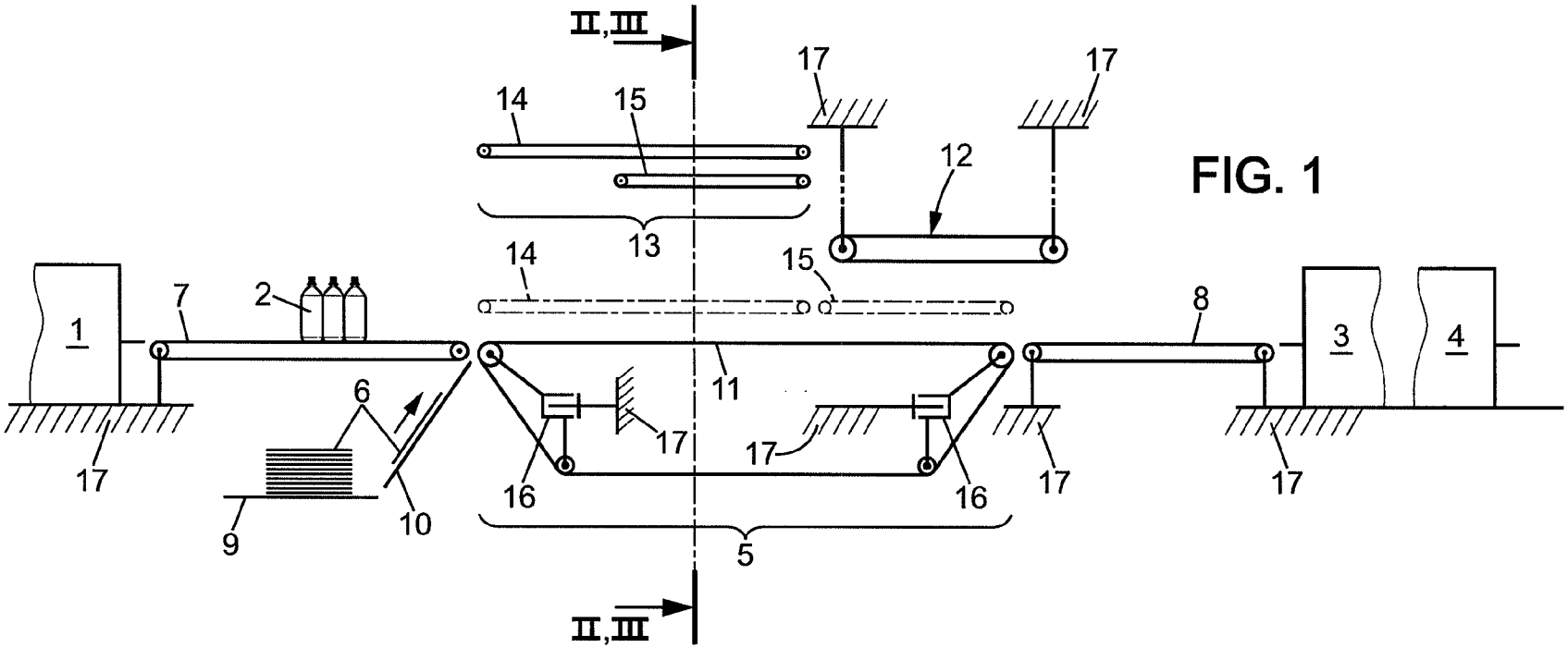
FIG. 1 is a diagrammatic view, in elevation, showing the main elements of the packaging installation according to the invention.

The installation shown in FIG. 1 corresponds to a packaging installation for batches of various products such as bottles, beverage cans, tins, pots etc.

This packaging installation comprises several parts: a station 1 for grouping and preparing the batches of products 2, situated at the infeed, a machine 3 of the packing machine type for placing a plastic film around the batch of products 2, said packing machine 3 being followed by a tunnel 4 for heat-shrinking said plastic film and, between said preparation station 1 and said packing machine 3, a forming module 5 which carries out the wrapping of the batch of products 2 using a blank 6 of the wrap-around or tray type.

This forming module 5 is inserted between an infeed conveyor 7 which brings the batches of products 2 from the preparation station 1 and an outfeed conveyor 8 which transports said batches of wrapped products 2 to the packing machine 3.

These two conveyors 7 and 8 flank the forming module 5 and this module 5 is associated with a magazine 9 which provides it with the appropriate blanks 6 by means of a conveying device 10.

These blanks 6 are conveyed towards the assembly station of the forming module 5 which comprises a conveyor 11 of the cleated belt type. The wrapping assembly station is fitted around the upper strand of the cleated belt conveyor 11 and comprises means for forming said blank 6 around the batch of products 2 and, in particular, an apparatus 12 which is situated above the end portion of the slider bed constituted by the downstream portion of said cleated belt conveyor 11. This apparatus 12 finishes the folding, forming and bonding of the blank 6, for wrapping the batch of products 2. This apparatus is adjustable, heightwise in particular, so as to adapt to the dimension of the products or the batches of products which pass through the installation.

A conveying system 13 is arranged above the forming module 5 in its upstream portion, and also upstream of the apparatus 12. This conveying system 13 is arranged so as to substitute for the cleated belt conveyor 11 when the packaging installation is intended to pass naked batches of products, i.e. batches of products which do not require a particular wrapping using a blank of the tray or wrap-around type.

This substitute conveying system 13 is situated in the footprint of the forming module 5; it comprises two transfer conveyor belts 14 and 15 which are represented, in thick lines, in the stand-by position. In this stand-by position, or idle position, they are superposed and retracted upstream of the apparatus 12 in order to allow the wrapping and packaging installation to operate.

In this FIG. 1, the transfer conveyor belts 14 and 15 are also represented in light dash-and-dot lines, abutting each other, positioned above the cleated belt conveyor 11, i.e. in an intermediate position, when they are placed in the active substitution position or the idle position.

FIG. 2 is a diagrammatic transversal elevation in cross-section along 2-2, showing the different elements of the packaging installation according to the invention, at the level of the substitute conveying system 13.

The cleated belt conveyor 11 is shown, constituted by two continuous belts 11*a* and 11*b* the separation of which is adjustable in order to take account of the dimensions of the batches of products 2 and the dimensions of the blank 6.

These two belts 11*a* and 11*b* are guided transversally using a system of guide rails 16 for adjusting their separation and, above all, to adopt extreme lateral positions which make it possible to free sufficient space in order to accommodate, as detailed below, the substitute conveyor system 13.

Above the cleated belt conveyor 11, the apparatus 12 of the belt or lug chain type is shown. This apparatus 12 is borne by supports which are integral with the common frame 17 of the installation and/or the forming module 5.

Above the apparatus 12, the substitute conveyor system 13 is shown in the idle position, i.e. in a position which is situated at a level substantially above the level of said apparatus 12.

FIG. 3 shows, in diagrammatic transversal cross-section along 3-3, the installation in a configuration which allows the passage of naked batches of products 2 at the level of the forming module 5, said module 5 being completely by-passed, i.e. it is totally non-operational.

In this FIG. 3, the belts 11*a* and 11*b* of the cleated belt conveyor 11 are separated from each other in order to leave space for the substitute conveying system 13, said conveying system 13 being positioned at the same level as the active portion of the belts 11*a* and 11*b*, serving as slider bed between the infeed conveyor 7 and the outfeed conveyor 8.

The apparatus 12 retains its position above the downstream portion of the forming module 5; it can be retracted heightwise depending on the dimension of the products. In this configuration of the installation, the batches of products 2 can move freely between the infeed conveyor 7 and the outfeed conveyor 8.

FIG. 4 shows, in the form of a diagrammatic elevation, the installation according to the invention and in particular the positioning of the substitute conveying system 13, between the infeed conveyor 7 and the outfeed conveyor 8.

This substitute conveying system 13 comprises a transfer conveyor belt 14 which serves as upstream transfer conveyor belt 14 and a transfer conveyor belt 15 which serves as downstream transfer conveyor belt 15. These two transfer conveyor belts 14 and 15 are in abutment with each other and respectively with the infeed conveyor 7 and the outfeed conveyor 8. They establish a continuity for the surface or slider bed for movement of the batches of products 2 between the infeed conveyor 7 and the outfeed conveyor 8.

The substitute conveying system 13 is borne, on each side, by a support in the form of a pantograph 19 which is articulated, at its upper part on the common frame 17 of the installation. The pantographs 19 bear a structure 20 on which the upstream transfer conveyor belt 14 is installed and this structure 20 serves as a support and guide for the frame 21 of the downstream transfer conveyor belt 15.

The downstream transfer conveyor belt 15 is borne by the frame 21 but in the active conveying position, as shown in FIG. 4, it is immobilized with respect to the frame 17 using legs 22 arranged vertically, said legs 22 serving as support for the downstream transfer conveyor belt 15 and resting on supports 23 arranged at the level of said common frame 17 in order to place said transfer conveyor belt 15 in the active substitution position, projecting in a downstream direction of the installation with respect to the upstream transfer conveyor belt 14.

The legs 22 are slidably mounted on the frame 21 and this frame 21 is itself guided on the structure using a system of guide rails 24 so as to be capable of moving from a downstream to an upstream position when, as shown in FIG. 5, the entire substitute conveying system 13 passes from the active substitution position to the idle position. The substitute conveying system 13 in fact comprises a sort of telescopic transfer conveyor belt which is constituted by the upstream transfer conveyor belt 14 and the downstream transfer conveyor belt 15.

Firstly, when it passes from this active position to the idle position, it is noted, as shown in FIG. 5 in light dash-and-dot lines, that the downstream transfer conveyor belt 15 moves vertically so as to pass below the level of the upstream transfer conveyor belt 14, guided by its frame 21 in which its legs 22, serving as its support, slide. This retraction of the downstream transfer conveyor belt 15 allows the latter to be positioned under the upstream transfer conveyor belt 14 before finishing the complete retraction of this substitute conveying system 13, as represented in thick lines in FIG. 5.

The pantograph system 19 comprises two arms 25 and 26 articulated together at the level of their median portion, forming scissors; they are articulated around a central pin 27 which is situated at least at the level of the apparatus 12, preferably substantially above. The arm 25 extends between an articulation 28 situated at the upper part of the installation, integral with the common frame 17, and an articulation 29 which is mobile on a system of guide rails 30 which extends longitudinally on the structure 20 which bears the upstream transfer conveyor belt 14.

In the same way, the arms 26 extend between a fixed point 31 situated on the structure 20 of the upstream transfer conveyor belt 14 and an articulation 32 which is mobile, guided on a system of guide rails 33 which is integral with the common frame 17 of the installation and/or of the forming module 5.

The deployment or the folding of the pantograph 19 is carried out, for example, using a screw-nut system; the screw 34 being interposed between the central pin 27 of the pantograph and a nut 35, said nut 35, operated by appropriate means, being firmly fixed to the common frame 17 by means of a bearing 36 mounted on an articulation 37.

This pantograph 19 is also delineated in FIG. 5, showing the position of the arms 25 and 26, said arms being sufficiently separated in order to provide a passage the width of which corresponds at least to the dimensions of the batches of products to be allowed to pass, said batches being transported by the substitute conveying system 13 constituted by the upstream and downstream transfer conveyor belts 14 and 15.

I claim:

1. A packaging installation for batches of products comprising, distributed on a single common frame: an infeed conveyor on which said products are arranged by batches, originating from a preparation and grouping station, an outfeed conveyor which removes said products in the form of batches to a packing machine and a module for forming a wrapping of a tray type or a wrap-around type between said infeed and outfeed conveyors, the module for forming a wrapping comprising a cleated belt conveyor constituted by two continuous belts forming a first slider bed which extends between said infeed conveyor and said outfeed conveyor, said continuous belts being adjustable transversally in order to alter the width of said first slider bed, the module for forming a wrapping also comprising an apparatus for folding and forming the wrapping, arranged above a downstream end portion of said first slider bed, said installation comprising means for retracting said continuous belts and means allowing the substitution of said continuous belts by a substitute conveying system capable of allowing simple passages of naked batches of products between said infeed conveyor and said outfeed conveyor, said substitute conveying system being inserted between said continuous belts in order to form a second and continuous slider bed between said infeed conveyor and said outfeed conveyor.

2. The packaging installation according to claim 1, wherein the substitute conveying system comprises an upstream transfer conveyor belt and a downstream transfer conveyor belt, said upstream and downstream transfer conveyor belts configured to be placed in abutment with each other and respectively with said infeed conveyor and said outfeed conveyor, said upstream and downstream transfer conveyor belts filling the gap between said infeed and outfeed conveyors after retracting said cleated belt conveyor.

3. The packaging installation according to claim 2, wherein the two transfer conveyor belts are mobile with respect to each other in a longitudinal direction of movement of the batches of products and in a vertical direction, said transfer conveyor belts being mobile with respect to each other between an idle position in which said transfer conveyor belts are superposed and an active position in which said transfer conveyor belts abut in order to form said second slider bed which extends between said infeed conveyor and said outfeed conveyor, substituting for said continuous belts of said cleated belt conveyor.

4. The packaging installation according to claim 3, wherein said substitute conveying system is vertically mobile, borne, on each side, by a support which is integral with said common frame and which extends above said first slider bed for the transportation of the batches of products, facing an upstream portion of said cleated belt conveyor and upstream of said apparatus for folding and forming the wrapping.

5. The packaging installation according to claim 4, wherein each support of said substitute conveying system is constituted by a pantograph which extends between said common frame and a structure which bears said upstream transfer conveyor belt, said structure serving, at the same time, as a guide for a frame of said downstream transfer conveyor belt.

6. The packaging installation according to claim 5, wherein said pantograph comprises scissor arms, arranged laterally and sufficiently spaced apart in the transversal direction so as to leave a free space allowing the passage of naked batches of products, said scissor arms being operated by appropriate means in order to change said substitute conveying system from said idle position to said active position and vice-versa, according to requirements.

7. The packaging installation according to claim 5, wherein said downstream transfer conveyor belt is arranged on a frame borne by said structure of said upstream transfer conveyor belt by means of a system of guide rails, said system of guide rails allowing, under the effect of operating means, the retraction of said downstream transfer conveyor belt under said upstream transfer conveyor belt in order to give said substitute conveying system, a footprint compatible with a space which is available upstream of said apparatus for folding and forming the wrapping and within the footprint of said module for forming a wrapping.

8. The packaging installation according to claim 5, wherein said downstream transfer conveyor belt is mounted mobile on a frame between an active substitution position in which said downstream transfer conveyor belt is situated at the level of said outfeed conveyor and an idle position in which said downstream transfer conveyor belt is situated below the level of said upstream transfer conveyor belt, said downstream transfer conveyor belt being mounted mobile with respect to said frame by means of legs which slide vertically in said frame, said active substitution position being obtained using supports arranged on said single common frame of the packaging installation and on which said legs rest.

9. The packaging installation according to claim 2, wherein said cleated belt conveyor is retracted by separating said continuous belts of said cleated belt conveyor from each other and transversally to said continuous belts.

* * * * *